US005430228A

United States Patent [19]

Ciambrone et al.

[11] Patent Number: 5,430,228

[45] Date of Patent: Jul. 4, 1995

[54] OZONE METHODS FOR THE DESTRUCTION OF CHEMICAL WEAPONS

[75] Inventors: David F. Ciambrone, El Toro; Charles L. Beard, Torrance, both of Calif.

[73] Assignee: Hughes Aircraft Company, Los Angeles, Calif.

[21] Appl. No.: 21,699

[22] Filed: Feb. 24, 1993

[51] Int. Cl.[6] ..... C06D 7/00

[52] U.S. Cl. ..... 588/200; 210/760

[58] Field of Search ..... 588/200; 210/760

[56] References Cited

U.S. PATENT DOCUMENTS

| | | | |
|---|---|---|---|
| H 1,189 | 5/1993 | Kirts | 588/200 |
| 3,920,547 | 11/1975 | Garrison et al. | 210/63 |
| 4,654,144 | 3/1987 | Sharkey et al. | 210/631 |
| 4,655,932 | 4/1987 | Roslonski | 210/709 |
| 4,784,699 | 11/1988 | Cowsar et al. | 134/42 |
| 4,949,641 | 8/1990 | Sayles | 102/293 |
| 5,236,072 | 8/1993 | Nunez et al. | 422/186.04 |

*Primary Examiner*—Daniel D. Wasil
*Assistant Examiner*—Daniel Jenkins
*Attorney, Agent, or Firm*—Geprgann S. Grunebach; Wanda K. Denson-Low

[57] ABSTRACT

A transportable ozone neutralization system (10) for neutralizing a chemical compound is provided. The neutralization system (10) includes an enclosure (12) for substantially containing a container, such as a chemical munition (28), within which the chemical compound to be neutralized is contained. The neutralization system (10) further includes a liquid phase neutralization system (62) and a vapor phase neutralization system (100) which utilize ozone manufactured from the air, to contact the liquid and vapor phase chemical compounds through a solvent. The system neutralizes the chemical compound by the action of ozone in breaking the chemical bonds with the compound.

34 Claims, 3 Drawing Sheets

10
12
14
16
18
20
22
24
26
28
30
32
34
36
38
40
42
44
46
48
50
52
54
56
58
60

OZONE METHODS FOR THE DESTRUCTION OF CHEMICAL WEAPONS

BACKGROUND OF THE INVENTION

1. Technical Field

The present invention relates generally to chemical reaction systems, and particularly concerns an ozone system for neutralizing a chemical compound.

2. Discussion

Recent peace time efforts have included the dismantling of large amounts of chemical weapons currently being held in stock piles. These chemical weapons include munitions such as missiles and other projectiles containing large amounts of chemicals that can be harmful to humans upon exposure. As part of the dismantling effort, it is desirable to neutralize these munitions by removing and neutralizing the chemicals contained therewithin.

The problems associated with the neutralization of chemical-containing munitions involve several considerations. Firstly, because exposure to these chemicals can be harmful to humans, it is desirable that the neutralization procedure enhance a containment of the liquid and vapor components of these chemicals. This reduces the likelihood that liquid or vapor components of these chemicals could escape from the dismantling site where they could come in contact with the surrounding ground or ground water, escape into the atmosphere or contact humans directly or indirectly.

Secondly, in the neutralization of chemical munitions, it is preferred that the procedure by which chemical compounds are removed from within chemical munitions can substantially purge the chemical compounds from within the munitions being dismantled.

Thirdly, it is undesirable to transport chemical munitions from their current stockpile locations to other locations where a neutralization facility is located, because of the possibility of damaging the munitions, and the associated possibility of allowing these chemical compounds to escape from within the munition enclosures. This possibility is especially apparent in the transportation of munitions over long distances by land, by air and by sea, in combination with the multiple handling procedures involved in such transportation. It is therefore desirable that a mobile neutralization system be employed that can be transported to a munitions stockpile location for on-site neutralization activity. The feasibility of this procedure, however, is currently limited by the use of certain neutralization chemicals and equipment which are themselves difficult or dangerous to transport, such as high temperature incinerators and chlorine.

The need therefore exists for a mobile chemical neutralization system that does not employ chemicals or equipment that are difficult or dangerous to transport, which is able to enhance a containment of both the liquid and vapor components of the chemical compounds being neutralized, and which is also able to substantially remove the chemical compounds from within chemical munitions.

SUMMARY OF THE INVENTION

In accordance with the teaching of the preferred embodiment of the present invention, a transportable ozone neutralization system for neutralizing a chemical compound is provided. The neutralization system of the present invention manufactures ozone from air at a munitions dismantling location, and chemically reacts the ozone with the compounds located within the munitions, thereby substantially converting the chemical compounds to a neutralized condition.

The neutralization system of the present invention includes a liquid phase neutralization apparatus in combination with a vapor phase neutralization apparatus which operate upon the liquid phase of chemical compounds extracted from a chemical munition and the vapor phase which escapes from the munition within a vacuum enclosure.

The advantages of this mobile ozone neutralization system include the ability to transport the system to the munitions stockpile, thereby eliminating the need for difficult or dangerous transportation of chemical munitions. The system of the present invention further eliminates the need for difficult or dangerous transportation of chemical reactants and equipment for neutralization through its use of an ozone generator which operates to produce ozone directly from the atmosphere. The system of the present invention also enhances a substantial removal of chemical compounds from within chemical munitions, thereby reducing the likelihood of harmful exposure to humans. The system of the present invention further enhances a containment of the chemical munitions being neutralized, thereby reducing the likelihood of escape of liquid and vapor phases of these chemical compounds to the ground or water nearby, or to the atmosphere.

Further understanding of the present invention, including additional benefits, objects and advantages, will be realized upon review of the drawings in view of the description thereof, detailed description of the preferred embodiment, and claims appended hereto.

BRIEF DESCRIPTION OF THE DRAWINGS

The various advantages of the present invention will become apparent to one skilled in the art after reading the following specification and by reference to the drawings in which.

DETAILED DESCRIPTION OF THE PREFERRED EMBODIMENTS

It should be understood from the outset that while this invention is described in connection with particular examples, the scope of the invention need not be so limited since those skilled in the art will appreciate that its teachings can be used in a much wider variety of industrial applications than the examples specifically mentioned herein.

Figure 1:
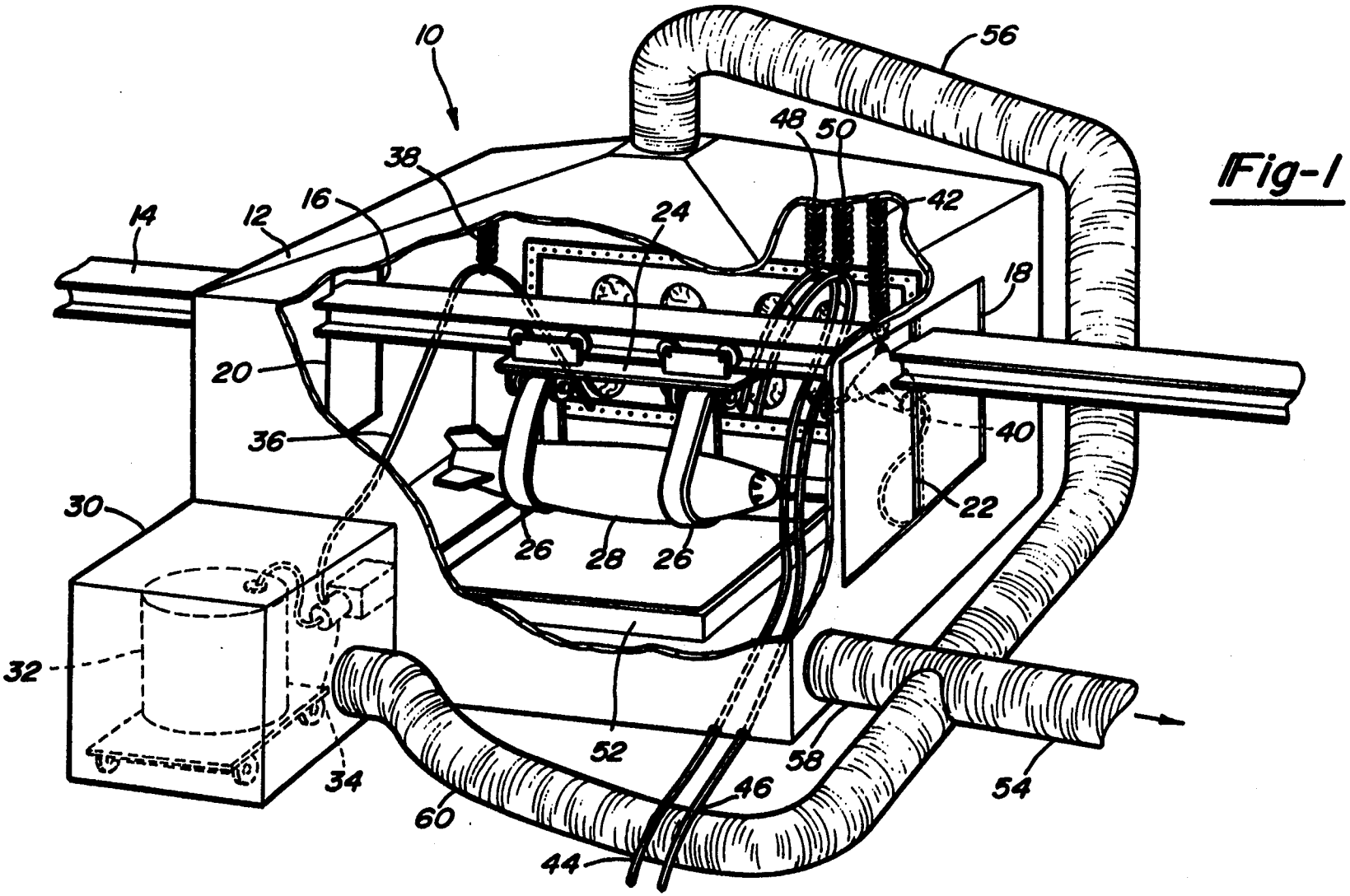
FIG. 1 is a perspective view illustrating a chemical neutralization apparatus of the present invention.

The ozone system for neutralizing a chemical compound in accordance with a preferred embodiment of the present invention will now be described with reference to FIG. 1. More particularly, FIG. 1 illustrates a neutralization apparatus, illustrated generally at 10. The neutralization apparatus 10 is shown to include an enclosure 12 within which a removal and transfer of chemical compounds from within a chemical munition or other container takes place. The enclosure 12 is in one preferred embodiment a substantially sealable tent facility that is operable to substantially contain a chemical munition located therewithin. In alternative embodiments, the enclosure 12 can be a lightweight, easily erectable building which is also operable for substantially containing a chemical munition located therewithin.

The enclosure 12 includes means for transporting a chemical munition from outside the enclosure 12 to within the enclosure 12 in a convenient manner. In a preferred embodiment, the means for transporting a chemical munition includes a rail 14 which passes into the enclosure 12 through a first opening 16, located at one end of the enclosure 12. The rail 14 traverses the interior of the enclosure 12 and exits the enclosure 12 through a second opening 18 located substantially opposite the first opening 16.

In order to enhance a substantially sealed condition within the enclosure 12, there are provided in one preferred embodiment covering means located in substantial proximity to the first opening 16 and the second opening 18. In a preferred embodiment, the covering means include a pair of first baffles 20 located in substantial proximity to the first opening 16, and a pair of second baffles 22 located in substantial proximity to the second opening 18. In preferred embodiments, the first baffles 20 and second baffles 22 are constructed from a tent canvas material or other material of similar type to that used for constructing the enclosure 12 in the embodiment of a tent, or are alternatively constructed of a flexible plastic material. It is preferred that the first baffles 20 and second baffles 22 be operable to substantially cover the first opening 16 and second opening 18, so as to enhance an enclosed environment within the enclosure 12. In addition, it is preferred that the first baffles 20 and the second baffles 22 be shaped to allow a passageway within which the rail 14 can pass without hindering the orientation of the first baffles 20 or second baffles 22. It is most preferred that a substantially sealed condition be enhanced through the use of overlapping pieces of material for the first baffles 20 and the second baffles 22, that are substantially precisely cut for fitting around the rail 14. In a preferred embodiment, the first baffles 20 and the second baffles 22 are easily movable so as to allow easy and convenient passage of a chemical munition between the baffles followed by a return to a rested position. This is accomplished in one preferred embodiment by attaching the first baffles 20 and the second baffles 22 at their top surfaces to the inside surface of the enclosure 12, at positions located adjacent to the top of the first opening 16 and the top of the second opening 18. It will be appreciated that in alternative embodiments, other suitable materials and arrangements for substantially enclosing a chemical munition located within enclosure 12 may be employed.

The neutralization apparatus 10 further includes a roller apparatus 24 for transporting a chemical munition into the enclosure 12 from the external environment. The roller apparatus 24 preferably includes a flexible and adjustable support means for holding a chemical munition or other container during the neutralization operation. In a preferred embodiment, the support means includes a plurality of support straps 26 that are removably attached to the roller apparatus 24, and are operable to support a chemical munition 28 by hanging from the roller apparatus 24. In alternative embodiments, other suitable means may be used for transporting a chemical munition or other container to within the enclosure 12 may be employed, and other suitable means for supporting a chemical munition or other container may also be employed.

The neutralization apparatus 10 is shown to include a bulk liquid removal system, generally illustrated at 30, for removing liquid phase chemicals from within the chemical munition 28. The bulk liquid removal system 30 is shown to include a storage tank 32 that is operable to receive liquid phase chemicals during the neutralization operation. It is preferred that the storage tank 32 be of a sufficient capacity so as to facilitate the removal of liquid phase chemicals from several chemical munitions before becoming filled, thereby reducing the need for frequent replacement of the storage tank 32. The bulk liquid removal system 30 is further shown to include a pump 34 that is operable to provide sufficient suction for retrieving liquid phase chemicals from within the chemical munition 28 and transporting them into the storage tank 32. The bulk liquid removal system is further shown to include a liquid purge line 36, disposed in communication with the pump 34, that is operable to provide a substantially enclosed passageway for the transport of liquid phase chemicals from within the chemical munition 28 to the storage tank 32. The liquid purge line 36 is preferably sized to a diameter that is suitable for insertion into a bore created into the casing of the chemical munition 28 during the neutralization operation. The liquid purge line 36 is preferably held at a convenient location by a suspension means, such as a first suspension spring 38, that is fixedly attached to the upper portion or the ceiling of the enclosure 12. This positioning of the liquid purge line 36 is preferred because it reduces resistance of the liquid purge line 36 against the bore created in the casing of the chemical munition 28, thereby reducing the likelihood of a spillage of liquid phase chemicals during the insertion, chemical removal and withdrawal operations.

It should be noted that the bulk liquid removal system 30 is shown to be located in a position substantially adjacent to but outside the enclosure 12. This arrangement allows for ready access to the bulk liquid removal system 30, while enhancing independence from the interior of the enclosure 12. In other alternative embodiments, the bulk liquid removal system 30 can be located within the enclosure 12, or can be located at any other convenient location.

The neutralization apparatus 10 further includes means for creating a bore into the casing of the chemical munition 28. In a preferred embodiment, the means for creating a bore is a drill 40, that is fitted with a bit operable for piercing the casing of the chemical munition 28. The drill 40 also preferably includes a depth limiting means for limiting the penetration of the drill bit only to the extent necessary to pierce the casing of the chemical munition 28. The drill 40 is preferably connected to an external AC power source (not shown), but can alternatively be of the type powered by batteries, generators or other power sources. In alternative embodiments, the means for creating a bore can be in the form of any other suitable piercing device. Also, the drill 40 is preferably located in a convenient position by means of a suspension means, such as a second suspension spring 42, that is fixedly attached to the upper portion or the ceiling of the enclosure 12.

The neutralization apparatus 10 is further shown to include an input line 44 and an output line 46 that are operable to provide substantially enclosed passageways for the transport of a purge liquid or solvent into and out from the chemical munition 28. The input line 44 and the output line 46 are preferably sized to a diameter suitable for insertion into one or more bores created in the casing surface of the chemical munition 28. The input line 44 and the output line 46 are shown to exit the enclosure 12, so as to be connected within the circuit of a liquid phase neutralization system, which will be described in detail later. The input line 44 and output line 46 are preferably positioned in a convenient location through the use of supporting means, such as a third suspension spring 48 and a fourth suspension spring 50, which are preferably fixedly attached to the upper portion or ceiling of the enclosure 12. This positioning of the input line 44 and the output line 46 is preferred because it reduces the resistance of both lines against the bore created in the casing of the chemical munition 28, thereby reducing the likelihood of a spillage of liquid phase chemicals during the insertion, neutralization and withdrawal operations.

The neutralization apparatus 10 is further shown to include a drip pan 52, located at the floor of the enclosure 12 beneath the anticipated location of the chemical munition 28 during the neutralization operation. The drip pan 52 is preferably sized so as to be operable to collect any liquid phase chemical compounds which may fall from the chemical munition 28, the liquid purge line 36, the drill 40, the input line 44 or the output line 46 during the neutralization operation.

The neutralization apparatus 10 is further shown to include a vacuum system 54 that is operable to withdraw the atmosphere, including any vapor phase chemical compounds which may escape from the chemical munition 28 during the neutralization operation, from within the enclosure 12. The vacuum system 54 is also operable to provide a substantially enclosed passageway for the atmosphere and vapor phase chemicals to be transported to a vapor phase neutralization system which will be described in detail later. The vacuum system 54 is shown to include a plurality of ducts, including an upper duct 56, a lower duct 58 and a bulk system duct 60, that are disposed in substantially sealed communication with the enclosure 12 and the bulk liquid removal system 30. The upper duct 56 is preferably connected to the enclosure 12 at the ceiling, thereby enhancing the removal of vapor phase chemicals which may rise within the enclosure 12. The lower duct 58 is preferably connected to the enclosure 12 near the floor of the enclosure 12, thereby enhancing the removal of any vapor phase chemicals which may descend to near the floor of the enclosure 12. The bulk system duct 60 is connected to the bulk liquid removal system 30, and is operable for removing vapor phase chemicals which may escape within the bulk liquid removal system 30.

The vacuum system 54 is operated by a vacuum pump (not shown), that is operable for providing the necessary suction to accomplish both the desired withdrawal from the enclosure 12 and the bulk liquid removal system 30, via the vapor phase neutralization system. A vacuum pump within the vapor phase neutralization system (not shown) provides the necessary suction to accomplish this desired withdrawal. It will be noted that in alternative embodiments, the vacuum system 54 may be of different configurations, depending upon the construction of other components of the neutralization apparatus 10.

Figure 2:
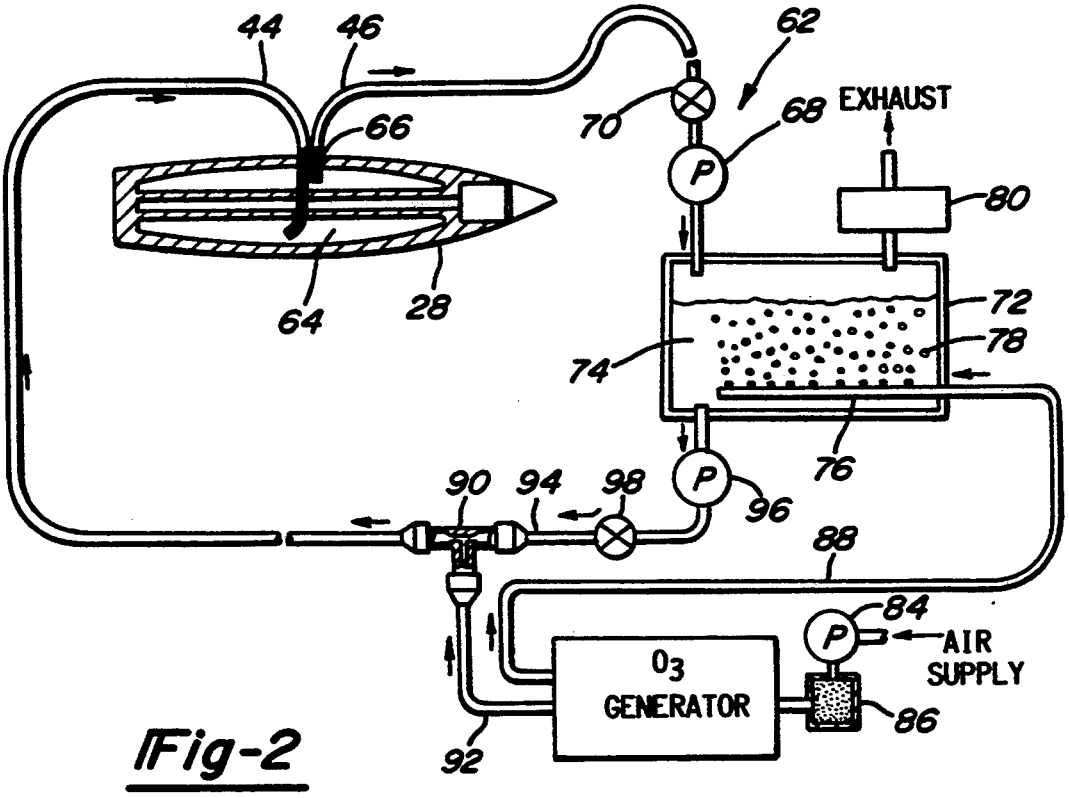
FIG. 2 is a schematic view illustrating a liquid phase neutralization system of the present invention.

The ozone system for neutralizing a chemical compound in accordance with a preferred embodiment of the present invention also includes a liquid phase neutralization system, which will now be described with reference to FIG. 2. More particularly, FIG. 2 illustrates a liquid phase neutralization system generally at 62. The liquid phase neutralization system 62 is shown to be disposed in communication with a chemical munition 28 of the type previously described within the neutralization apparatus 10 in FIG. 1. In more detail, the chemical munition 28 is shown to include an annular-shaped chemical tank 64 that is operable to contain the chemical compound or compounds used in chemical warfare. Also shown in connection with the chemical munition 28 are input line 44 and output line 46, whose ends are inserted into the chemical tank 64 of the chemical munition 28 through a bore 66, located preferably along the upper surface of the chemical munition 28, so as to prevent substantial losses of liquid phase chemical compounds from within the chemical tank 64. In a preferred embodiment, the input line 44 is inserted into the chemical tank 64 to a position substantially near the bottom of the chemical munition 28, while the output line 46 is inserted into the chemical tank 64 so that its end is disposed near the top portion of the chemical munition 28. Without wishing to be bound by theory, it is believed that the input of solvent into the chemical tank 64 from the bottom enhances a flushing action within the chemical tank 64, thereby enhancing removal of liquid phase chemical compounds from within the chemical tank 64. It should be noted that the relative sizes and locations of the chemical munition 28 and its components, as well as the input line 44 and output line 46 are for illustration purposes only, and are not meant to delineate or limit relative orientations or sizes of components mentioned herein.

Disposed within the output line 46 is a first solvent pump 68 that is operable to transport solvent and any liquid phase chemical compound contained therewithin, from the chemical munition 28 and through the output line 46. Also disposed within the output line 46 is valve 70 that is operable for regulating the flow of solvent through the output line 46. At the end of the output line 46 opposite the chemical munition 28 there is provided a liquid phase reactor 72 that is operable to contain a solvent 74 of the type suitable for circulating through the liquid phase neutralization system 62 and transporting liquid phase chemical compounds from within the chemical munition 28 to the liquid phase reactor 72. In a preferred embodiment, the solvent 74 is water although in other embodiments, other suitable solvents may be used. The liquid phase reactor 72 preferably has a solvent capacity of from about 300 gallons to about 400 gallons, although in other embodiments, different volumes may be used. In a preferred embodiment, the entire liquid phase neutralization system 62 is operable to contain from about 220 gallons to about 420 gallons of solvent, although in other embodiments, different volumes may be used.

The liquid phase reactor 72 is shown to include an aerator 76 which is operable to inject very fine ozone bubbles, illustrated generally at 78, through the solvent 74. Preferably the aerator 76 is located near the bottom of the liquid phase reactor 72, so as to allow ozone bubbles 78 to rise within the solvent 74. The aerator 76 is preferably operable to introduce from about 0.13 pounds to about 0.15 pounds of ozone per hour into the liquid phase reactor 72.

The liquid phase reactor 72 is further shown to include a charcoal filter 80 that is operable for enhancing a neutralization of any vapor phase chemical compounds which may emanate from the liquid phase chemical compounds passing through the liquid phase reactor 72. The charcoal filter 80 is also operable to provide a substantially enclosed passageway to the atmosphere for ozone introduced through the aerator 76 and any gases produced by the neutralization reaction.

The liquid phase neutralization system 62 also includes a first ozone generator 82 that is operable to receive air from the atmosphere and manufacture ozone from oxygen molecules in the air. The first ozone generator 82 may be of any type well known to those skilled in the art. Disposed in communication with the first ozone generator 82 are a first air pump 84 that is operable to provide air from the atmosphere to the first ozone generator 82, and a first air filter 86, that is preferably operable to remove contaminants including dust from the air, as well as other contaminants such as oil which may become introduced into the air within the first air pump 84. Disposed in communication with the first ozone generator 82 is a first ozone supply line 88 that is operable to provide a substantially enclosed passageway for the transport of ozone produced by the first ozone generator 82 to the aerator 76.

The liquid phase neutralization system 62 is further shown to include a venturi 90 that is operable to expose a fine stream of solvent containing liquid phase chemical compounds to a fine stream of ozone bubbles (not shown) provided by the first ozone generator 82 through a second ozone supply line 92. Disposed in communication between the venturi 90 and the liquid phase reactor 72 is a solvent circulation line 94 that is operable to provide a substantially enclosed passageway for solvent and any liquid phase chemical compounds contained therewithin. Disposed within the solvent circulation line 94 is a second solvent pump 96 that is operable to transport solvent and any liquid phase chemical compound contained therewithin from the liquid phase reactor 72 and through the venturi 90. Also disposed within the solvent circulation line 94 is a second valve 98 that is operable for regulating the flow of solvent through the solvent circulation line 94, and for closing the solvent circulation line 94 altogether. The second solvent pump 96 is preferably a bidirectional pump that can be reversed following the neutralization process for removing the contents of the input line 44, the venturi 90, the solvent circulation line 94 and the second valve 98 and delivering them back to the liquid phase reactor 72.

In a preferred embodiment, the venturi 90 is operable to provide a narrowed stream of solvent and liquid phase chemical compounds for substantial contact with a fine stream of ozone bubbles (not shown) provided by the first ozone generator 82. This arrangement is believed to enhance the neutralization of liquid phase chemical compounds within the solvent before recirculation into the chemical munition 28. The input line 44 is disposed in communication with the venturi 90 at its end opposite the chemical munition, thereby providing a substantially enclosed passageway for the recirculation of solvent from the liquid phase neutralization system 62 into the chemical munition 28.

It is preferred that the liquid phase neutralization system 62 provides a repeated rinsing of liquid phase chemical compounds from the internal surfaces of the chemical tank 64 by operating in repetitive, continuous recirculating cycles, thereby enhancing a continuous reduction in the amount of liquid phase chemical compounds located within the system taken as a whole.

The ozone bubbles 78 that are provided through the aerator 76 are preferably operable to break down liquid phase chemical compounds through the breaking of certain chemical bonds, including cyanide-carbon bonds, phosphorous-oxygen bonds, chlorine-carbon bonds, sulfur-carbon bonds and carbon-carbon double and triple bonds. It is the breaking of these chemical bonds by the ozone bubbles 78 passing through the solvent 74, as well as the ozone bubbles (not shown) passing in contact with the solvent recirculating through the venturi 90, that enhance a neutralization of the liquid phase chemical compounds from the chemical munition 28.

Figure 3:
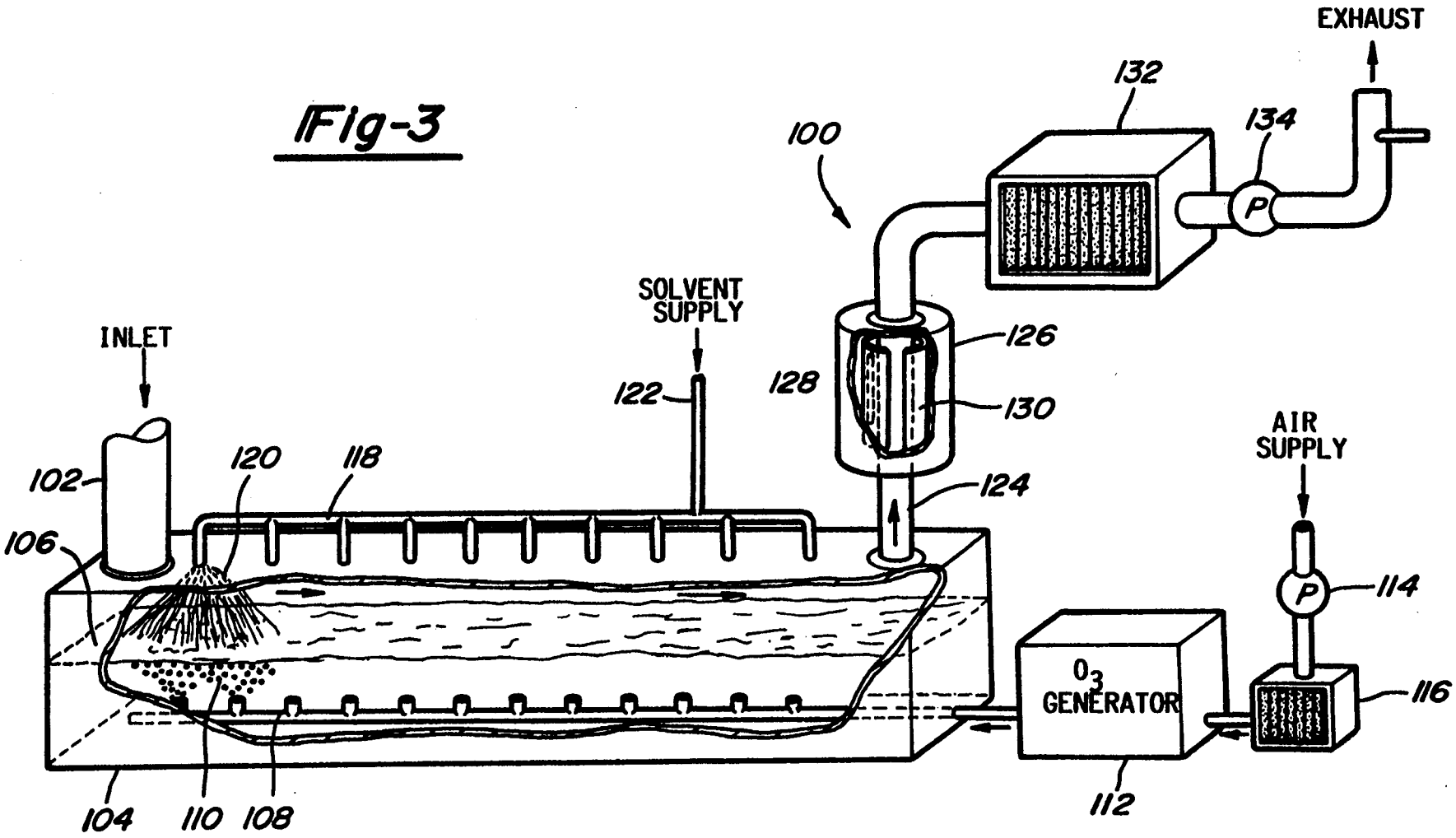
FIG. 3 is a perspective view illustrating a vapor phase neutralization system of the present invention.

The ozone system for neutralizing a chemical compound in accordance with a preferred embodiment of the present invention further includes a vapor phase neutralization system, illustrated generally in FIG. 3 at 100. The vapor phase neutralization system 100 is shown to include a vapor inlet port 102, that is disposed in communication with and is operable to receive vapor phase chemical compounds through the vacuum system 54 illustrated in FIG. 1. The vapor phase neutralization system 100 is further shown to include a vapor phase reactor 104 that is connected to and receives vapor phase chemical compounds through the vapor inlet port 102. Preferably, the vapor inlet port 96 is located at one end of the vapor phase reactor 98, so that the entire length of the vapor phase reactor 98 is utilized for the vapor phase neutralization operation. The vapor phase reactor 104 is further shown to contain a solvent 106, which may be of the same type as the solvent 74 located within the liquid phase reactor 72 and recirculated throughout the liquid phase neutralization system 62. Disposed within the vapor phase reactor 104 is an aerator 108 which is preferably located near the bottom of the vapor phase reactor 104 and is operable for providing ozone bubbles 110 in an upward direction through the solvent 106.

In similar fashion to the liquid phase neutralization system 62 illustrated in FIG. 2, the vapor phase neutralization system 100 includes a second ozone generator 112 which may be the same unit or a separate unit from the first ozone generator 82 used within the liquid phase neutralization system 62. As before, the second ozone generator 112 is accompanied by a second air pump 114 that is operable to provide air from the atmosphere to the second ozone generator 112. Also included in communication with the second ozone generator 112 is a second air filter 116 that is operable to remove the same contaminants from the atmosphere and from the second air pump 114 as the first air filter 86 discussed previously in connection with the liquid phase neutralization system 62.

The vapor phase reactor 104 is further shown to include a solvent sprayer 118, which is preferably located at the top of the vapor phase reactor 104 and is operable to provide a continuous finely dispersed solvent spray 120 along the entire length of the vapor phase reactor 104 from the top of the vapor phase reactor 104 downward into the solvent 106. Disposed in communication with the solvent sprayer 118 is a solvent supply line 122 that is operable to provide solvent from a source (not shown) to the solvent sprayer 118. In a preferred embodiment, the solvent 106, as well as the solvent provided by the solvent supply line 122 and introduced via the solvent sprayer 118, is water. In alternative embodiments, the solvent can be any other suitable liquid.

The solvent sprayer 118 is preferably operable to rinse vapor phase chemical compounds passing through the length of the vapor phase reactor 104 above the solvent 106 downward into the solvent 106. It is therefore preferred that the solvent spray 120 pass through as much of the space within the vapor phase reactor 104 above the solvent 106 as possible, thereby increasing the likelihood of rinsing vapor phase chemical compounds into the solvent 106. Within the solvent 106, the action of the ozone bubbles 110 is preferably operable,to enhance a breaking of the same chemical bonds within the chemical compounds in similar fashion to that occurring within the liquid phase reactor 72 illustrated in FIG. 2.

The air traveling through the top portion of the vapor phase reactor 104, as well as ozone introduced through the aerator 108, are able to exit the vapor phase reactor 104 through a vapor outlet port 124, which is disposed in communication with an ultraviolet light exposure chamber 126. The ultraviolet light exposure chamber 126 is shown to include an ultraviolet light source 128 of a type well known to those skilled in the art and a cylindrically-shaped mirror 130. The ultraviolet light source 128 is operable to provide ultraviolet light of wavelength between 185 and 254 nm. The ultraviolet light source 128 is further operable to expose the vapor traveling through the ultraviolet light exposure chamber 26 to ultraviolet light, which exposure is believed to enhance a further breakdown of the same chemical bonds within the vapor phase chemical compounds as are broken within the liquid phase neutralization system 62 and within the solvent 106. The mirror 130 is preferably oriented in a substantially circular fashion within the ultraviolet light exposure chamber 126, so as to reflect and distribute ultraviolet light substantially throughout the ultraviolet light exposure chamber 126. This arrangement enhances exposure of the vapor passing through the ultraviolet light exposure chamber 126 to ultraviolet light.

Disposed in communication with the ultraviolet light exposure chamber 126 is a charcoal filter 132 of similar type to the charcoal filter 80 previously mentioned in connection with the liquid phase neutralization system 62. Preferably, the charcoal filter 132 is operable to enhance a further neutralization of any vapor phase chemical compounds passing therethrough. The air and ozone introduced through the aerator 108 are forced out from the vapor phase reactor 104 and through the vapor outlet port 124, the ultraviolet light exposure chamber 126 and the charcoal filter 132 by means of an exhaust pump 134 located directly after the charcoal filter 132. The exhaust pump 134 is preferably operable to provide the suction through the vapor phase neutralization system 100.

The chemical compounds against which the ozone system of the present invention are intended to operate include ethyl N,N-dimethylphosphoramido-cyanidate ($C_5H_{11}N_2O_2P$) (GA, Tabun), O-ethyl-S-(2-diisopropylaminoethyl)methylphosphonothioate ($C_{11}H_{26}NO_2PS$) (VX), Dichloro-2-chlorovinylarsine ($C_2H_2AsCl_3$) (Lewisite), Isopropyl Methylphosphonofluoridate ($C_4H_{10}FO_2P$) (GB, Sarin), Bis(2-chloroethyl) sulphide 2,2'-dichloro diethyl sulphide ($C_4H_8Cl_2S$) (mustard gas, sulphur mustard, H, HD), Cyclohexyl methylphosphonofluoridate ($C_7H_{14}FO_2P$) (GF), Diphenylamine chloroarsine $C_6H_4(AsCl)(NH)C_6H_4$) (adamsite, phenarsazine chloride, DM), methylphosphonofluoridic acid-1,2,2-trimethylpropylester (soman), and 2,2-di(3-chloroethyithio)-diethylether(T). It will be appreciated, however, that the ozone system of the present invention may be effective toward enhancing a neutralization of other compounds besides those listed above.

Thus, in operation, the preferred method of the present invention for neutralizing a chemical compound is now described. With reference again to FIG. 1, the vacuum system 54 is operated so as to enhance a removal of any vapor phase chemical compounds which may escape from within the chemical munition 28 during the neutralization process. A chemical munition 28 is then introduced into the enclosure 12 by inserting the chemical munition 28 into the support straps 26, so as to suspend the chemical munition 28 from the roller apparatus 24 in a substantially immobilized condition. In order to maintain a favorable balance for the chemical munition 28, it is preferred that the chemical munition 28 be positioned upon the support straps 26 so that the support straps 26 are able to hang in a substantially vertical position from the roller apparatus 24, and also so that the support straps 26 are located substantially equidistant from the ends of the chemical munition 28. The chemical munition 28 is then introduced into the enclosure 12 by moving the roller apparatus 24 along the rail 14 in a longitudinal direction through the first opening 16. The first baffles 20 are temporarily separated so as to allow convenient passage of the chemical munition 28 through the first opening 16, after which time the first baffles 20 are preferably reoriented in their original position, so as to substantially cover the first opening 16. It is preferred that the chemical munition 28 be moved in a longitudinal direction along the rail 14 to a central position within the enclosure 12 that is substantially directly above the drip pan 52.

Once the chemical munition 28 has been properly located within the enclosure 12, a bore is created in the upper surface of the chemical munition 28 through the use of the drill 40, thereby creating a bore 66 as shown in FIG. 2. The liquid purge line 36 is then inserted into the bore 66, and is preferably located near the bottom of the chemical tank 64 within the chemical munition 28. The bulk liquid removal system 30 is then operated by activating the pump 34, thereby causing liquid phase chemicals from within the chemical munition 28 to be transported through the liquid purge line 36 and into the storage tank 32. The bulk liquid removal system 30 is preferably operated until a substantial portion of the liquid phase chemicals within the chemical munition 28 have been transferred into the storage tank 32. Once this transfer of liquid phase chemicals has been substantially completed, the operation of the pump 34 is discontinued and the liquid purge line 36 is removed from the chemical munition 28. At this time, the storage tank 32 may optionally be disconnected from and removed from within the bulk liquid removal system 30 for proper disposal. Also, it should be noted that the liquid purge line 36 and pump 34 may be used to remove any liquid phase chemicals which have dropped from the chemical munition into the drip pan 52 located below.

Once the bulk liquid removal operation has been completed, the input line 44 and the output line 46 are inserted into the bore 66. As shown in FIG. 2, it is preferred that the input line 44 be inserted into the bottom portion of the chemical tank 64, while the output line 46 is preferably inserted only into the top portion of the chemical tank 64, as shown in FIG. 2.

With reference now to FIG. 2, the operation of the liquid phase neutralization system 62 will now be described in further detail. The first ozone generator 82 is set into operation with the operation of the first air pump 84, thereby introducing air from the atmosphere into the ozone generator 82. This operation begins the flow of ozone through the first ozone supply line 88 and the second ozone supply line 92. At the same time, the first solvent pump 68 and the second solvent pump 96 are set into operation, and the first valve 70 and second valve 98 are opened, thereby initiating a recirculating flow of the solvent 74 from within the liquid phase reactor 72 through the solvent circulation line 94, the venturi 90 and the input line 44. As solvent exits the input line 44 and enters the chemical tank 64 within the chemical munition 28, the solvent fills the chemical tank 64, thereby rinsing the internal walls of the chemical tank 64 and suspending liquid phase chemicals within the solvent. Once sufficient solvent is introduced into the chemical tank 64 so as to substantially fill this reservoir, the suction action of the first solvent pump 68 operates to remove solvent and the liquid phase chemicals contained therewithin, and deliver them to the liquid phase reactor 72 through the output line 46. Once the solvent has reached the liquid phase reactor 72, a continuous recirculation of solvent has been initiated between the chemical munition 28 and the liquid phase neutralization system 62. The continuous recirculation can be controlled by the adjustment of the first valve 70 to optimize the suction from the chemical munition 28, and by the adjustment of the second valve 98 to optimize the flow rate through the venturi 90.

The continuous recirculation of solvent through the liquid phase neutralization system 62 continually rinses the inside surfaces of the chemical tank 64 and transfers solvent containing liquid phase chemicals into the liquid phase reactor 72. In the liquid phase reactor 72, the solvent 74 containing liquid phase chemicals from the chemical munition 28 is acted upon by ozone bubbles 78 being introduced into the liquid phase reactor 72 through the aerator 76, thereby breaking the bonds in the chemical compounds. It is preferred that the operation of the liquid phase reactor 72 be sufficient to substantially neutralize the liquid phase chemical compounds as they are transferred into the liquid phase reactor 72, but before they leave the liquid phase reactor 72 along with solvent being recirculated to the chemical munition 28. Exhaust gases from the liquid phase neutralization system 62, which include hydrogen carbon dioxide, nitrogen, water, nitrous oxide and oxygen, produced by the neutralization reaction pass through the charcoal filter 80, whereby further neutralization is enhanced. The remaining gases are then exhausted to the atmosphere from the charcoal filter 80.

During the recirculation operation of the liquid phase neutralization system 62, solvent 74 is drawn from the liquid phase reactor 72 by the action of the second solvent pump 96 through the solvent circulation line 94 and into the venturi 90. In the venturi 90, ozone produced by the first ozone generator 82 and through the second ozone supply line 92 is dispersed into fine bubbles and contacts the fine stream of the solvent traveling through the venturi 90. The venturi 90 is also operable to enhance a neutralization of liquid phase chemical compounds remaining in the solvent after the operation of the liquid phase reactor 72. The solvent is then recirculated through the input line 44 back into the chemical munition 28, after which the above-described process continues in a repetitive recirculatory fashion for a time sufficient to enhance a substantial neutralization of liquid phase chemical compounds from within the chemical munition 28.

It should be noted that in one preferred embodiment, the action of the liquid phase reactor 72 and the venturi 90 are operable to substantially neutralize the liquid phase chemical compounds passing through the liquid phase neutralization system 62 during one complete circulation run. However, it should also be noted that in other preferred embodiments, as solvent recirculates pass the venturi 90, and is reintroduced into the chemical munition 28 each portion of solvent undergoes a repetitive series of circulatory runs involving a reduction in liquid phase chemical compound concentration within the solvent through the liquid phase reactor 72 and the venturi 90, so that over a period of time, the recirculation of solvent through the entire liquid phase neutralization system 62 results in a gradual reduction in the amount of liquid phase chemical compounds present within the system. It is preferred in this embodiment that the liquid phase neutralization system 62 be operated in this recirculating mode at a recirculation rate of from about 2 gallons to about 5 gallons per minute, although in other embodiments, different recirculation rates may be used. It is also preferred that the liquid phase neutralization system 62 be operated in this recirculation mode for from about 10 minutes to about 45 minutes, although in alternative embodiments, different durations of operation may be used. It should be noted that the duration of operation is highly dependent on the type of chemical agent in the munition.

Once the desired operation of the liquid phase neutralization system 62 has been completed, the recirculation of solvent is discontinued by closing the second valve 98. The remaining solvent within the chemical tank 64 can then be removed by inserting the output line 46 to the bottom portion of the chemical tank 64 in similar fashion to the location of the input line 44. The operation of the first solvent pump 68 is then utilized to substantially remove the remaining solvent from within the chemical munition 28, as well as from within the output line 46 and the first valve 70, and transfer it to the liquid phase reactor 72. Once this has been substantially completed, the second solvent pump 96 is reversed in direction and the second valve 98 is reopened to facilitate the transfer of remaining solvent from within the input line 44, the venturi 90, the solvent circulation line 94 and the second valve 98 to the liquid phase reactor 72. Once this has been completed, the second valve 98 and the first valve 70 are closed, so that the input line 44 and output line 46 can be removed from the bore 66. The chemical munition 28 is then removed from the enclosure 12 by moving the chemical munition 28 in a longitudinal direction along the rail 14 through the second opening 18. In similar fashion to the introduction of the chemical munition 28 into the enclosure 12, the second baffles 22 are preferably temporarily separated so as to allow easy transport of the chemical munition 28 through the second opening 18. Once the chemical munition 28 has been removed from the enclosure 12, it can be disposed of in any suitable manner well known to those skilled in the art.

During the operation of the liquid phase neutralization system 62, the vapor phase neutralization system 100 is also in operation to enhance a neutralization of any vapor phase chemicals which may become present within the enclosure 12 during the liquid phase neutralization operation.

The operation of the vapor phase neutralization system 100 will now be described with reference to FIG. 3. The operation of this system is intended to run simultaneously with that of the liquid phase neutralization system 62. At the time that the first ozone generator 82 within the liquid phase neutralization system 62 is operated, the second ozone generator 112 within the vapor phase neutralization system 100 is also operated, along with air pump 114, so as to provide a supply of ozone to the vapor phase reactor 104. The exhaust pump 134 is also operated at this time to provide a flow throughout the vapor phase neutralization system 100. By operation of the vacuum system 54, the atmosphere from within the enclosure 12, which may include vapor phase chemical compounds, is introduced into the vapor phase reactor 104 through the vapor inlet port 102. As the vapor phase gases travel through the vapor phase reactor 104, solvent supplied through the solvent supply line 122 is introduced into the vapor phase reactor 104 through the solvent sprayer 118. The solvent sprayer 118 forces vapor phase chemicals passing through the vapor phase reactor 104 into the solvent 106 located in the bottom portion of the vapor phase reactor 104. In similar fashion to the operation of the liquid phase reactor 72, ozone bubbles 110 introduced into the vapor phase reactor 104 through the aerator 108 and passing through the solvent 106 enhance a neutralization of vapor phase chemicals which have been transferred into the solvent 106. In a preferred embodiment, a substantial amount of vapor phase chemicals which enter the vapor phase reactor 104 are transferred into the solvent 106 over the length of the vapor phase reactor 104.

Exhaust gases exiting the vapor phase reactor 104 pass through the vapor outlet port 124 and into the ultraviolet light exposure chamber 126, where a neutralization of vapor phase chemicals is enhanced through exposure to the ultraviolet light source 128 and through dispersion of the ultraviolet light by the mirror 130. After traveling through the ultraviolet light exposure chamber 126, the exhaust gases travel through the charcoal filter 132 where neutralization of vapor phase chemical compounds is further enhanced. The exhaust gases from the vapor phase neutralization system 100, which include hydrogen, carbon dioxide, nitrogen, nitrous oxide ($NO_x$), water and oxygen produced by the neutralization reaction are then exhausted to the atmosphere by means of the exhaust pump 134.

The vapor phase neutralization system 100 is preferably operated continuously from the time before a bore is created within the chemical munition 28 through the time that the liquid phase neutralization operation is completed. It should be noted that as the above process can be repeated for a number of chemical munitions sequentially, the vapor phase neutralization system 100 is preferably operated continuously from before the first chemical munition is the enclosure 12, until after the last chemical munition is removed. The present invention is also preferably provided with some means for regeneration of the materials involved in the process. As the charcoal filters 80 and 132 become attached with molecules of the chemical compounds being neutralized, the charcoal filters 80 and 132 can be regenerated by passing ozone directly through the filters. This enhances the efficiency of the system and also reduces the replacement requirements for the charcoal filters 80 and 132, thereby saving time and expense.

In one preferred embodiment, the chemical reaction constituting the neutralization activity can be enhanced through the use of catalyst materials (not shown). These catalyst materials are preferably metal oxide catalysts in granulated or pellet form, selected from the group consisting of manganese oxide, nickel oxide, iron oxide, sponge nickel, platinum group metals and titanium dioxides. Most preferred catalysts are nickel, nickel oxide and titanium dioxides. Alternatively, other suitable catalysts may be used. The catalyst materials require the presence of both the ozone and the chemical compounds to be neutralized for their effectiveness. As such, the following locations are contemplated for the addition of suitable catalysts. Firstly, a canister (not shown) containing the catalyst may be inserted into the output line 46, so that the recirculating solvent from the chemical munition 28 may pass over the granules or pellets of the catalyst. Secondly, an independently circulating system including a canister (not shown) containing the catalyst may be added in communication with the liquid phase reactor 72. This system would include a separate pump (not shown) for removing solvent from the liquid reactor 72, passing it through the catalyst canister, and returning it to the liquid phase reactor 72. The catalyst materials can also be added to the vapor phase neutralization system 100, in the form of a catalyst canister (not shown) inserted between the ultraviolet light exposure chamber 126 and the charcoal filter 132.

Another aspect contemplated by the present invention is the neutralization of chemical compounds located on the surfaces of or within materials, or other accessories used in connection with or located adjacent to the neutralization apparatus 10, the liquid phase neutralization system 62 and the vapor phase neutralization system 100. These materials include salt, sand, wiping cloths, uniforms, drill bits and other materials and accessories. These materials and accessories can be cleaned under this aspect of the present invention by neutralizing the chemical compounds on these surfaces and within these materials by immersing them in an ozonated water or other suitable solvent bath. The ozone reacts with the chemical compounds in the same manner as described previously. Alternative embodiments of this aspect of the invention include the use of a fluidized bed, tumbling barrel or washing machine—type-devices, which enhance cleaning effectiveness by movement of the surfaces or materials to be cleaned, dissolution of the chemical compounds within the solvent, and increased exposure to ozone bubbles passing through the solvent.

While the above description discusses a preferred embodiment of the present invention, it will be understood that the description is exemplary in nature and is not intended to limit the scope of the invention. For example, the method of the present invention can be utilized in connection with containers other than chemical munitions and with chemicals other than those used in chemical warfare. Also, the configuration described in the preferred embodiment of the present invention can be altered without departing from the spirit and scope of the invention. The present invention will therefore be understood as susceptible to modification, alteration and variation by those skilled in the art without deviating from the scope and meaning of the following claims.

What is claimed is:

1. An ozone neutralization system for neutralizing a chemical compound comprising:

purging means being operable to remove said chemical compound from a source;

neutralization means being operable to receive said chemical compound from said purging means, said neutralization means further being operable to expose said chemical compound to ozone, said ozone being effective for breaking at least one chemical bond in said chemical compound; and an ozone source for providing ozone to said neutralization means.

2. The ozone neutralization system according to claim 1 wherein said chemical compound includes a liquid phase component, and wherein said purging means comprises a delivery line being operable to provide a substantially enclosed passageway for a delivery of said liquid phase component from said source to said neutralization means.

3. The ozone neutralization system according to claim 2 wherein said purging means further comprises a preselected amount of a solvent, said solvent being operable to suspend said liquid phase component within said source, said solvent being operable to suspend said liquid phase component during delivery from said source to said neutralization means.

4. The ozone neutralization system according to claim 3 wherein said purging means further comprises a solvent recirculation line being operable to provide a substantially enclosed passageway for a recirculation of said solvent from said neutralization means to said source.

5. The ozone neutralization system according to claim 2 wherein said purging means further comprises a first pump disposed in communication with said delivery line and said neutralization means, said first pump being operable to deliver said liquid phase component through said delivery line from said source to said neutralization means.

6. The ozone neutralization system according to claim 4 wherein said purging means further comprises a second pump disposed in communication with said neutralization means and said source, said second pump being operable to recirculate said solvent through said solvent recirculation line from said neutralization means to said source.

7. The ozone neutralization system according to claim 1 wherein said chemical compound includes a liquid phase component, and wherein said neutralization means comprises a liquid phase reactor.

8. The ozone neutralization system according to claim 7 wherein said liquid phase reactor is operable to contain a solvent, said solvent being operable to suspend said liquid phase component within said liquid phase reactor.

9. The ozone neutralization system according to claim 8 wherein said neutralization means further comprises an aerator disposed in communication with said liquid phase reactor, said aerator being operable to introduce ozone into said liquid phase reactor.

10. The ozone neutralization system according to claim 1 wherein said chemical compound includes a liquid phase component, and wherein said neutralization means comprises a venturi.

11. The ozone neutralization system according to claim 1 wherein said chemical compound includes a vapor phase component, and wherein said purging means comprises:

an enclosure being operable to substantially contain said source, said enclosure being operable to capture said vapor phase component; and a vacuum system operable to deliver said vapor phase component to said neutralization means.

12. The ozone neutralization system according to claim 11 wherein said enclosure comprises a tent.

13. The ozone neutralization system according to claim 11 wherein said enclosure comprises a temporary building.

14. The ozone neutralization system according to claim 11 wherein said vacuum system comprises at least one duct for providing a substantially enclosed passageway for a delivery of said vapor phase component from said source to said neutralization means.

15. The ozone neutralization system according to claim 1 wherein said chemical compound includes a vapor phase component, and wherein said neutralization means comprises a vapor phase reactor.

16. The ozone neutralization system according to claim 15 wherein said vapor phase reactor is operable to contain a solvent, said solvent being operable to suspend said vapor phase component within said vapor phase reactor.

17. The ozone neutralization system according to claim 16 wherein said neutralization means further comprises a solvent sprayer disposed in communication with said vapor phase reactor, said solvent sprayer being operable to contact said solvent with said vapor phase component.

18. The ozone neutralization system according to claim 17 wherein said neutralization means further comprises an aerator disposed in communication with said vapor phase reactor, said aerator being operable to introduce ozone into said vapor phase reactor.

19. The ozone neutralization system according to claim 1 wherein said chemical compound includes a vapor phase component, and wherein said neutralization means comprises an ultraviolet light exposure chamber.

20. The ozone neutralization system according to claim 19 wherein said ultraviolet light exposure chamber includes an ultraviolet light source being operable to provide ultraviolet light of wavelength from about 185 nm to about 254 nm.

21. The ozone neutralization system according to claim 1 wherein said chemical compound includes a vapor phase component, and wherein said neutralization means comprises a charcoal filter.

22. The ozone neutralization system according to claim 1 wherein said ozone source comprises an ozone generator, said ozone generator being operable to manufacture ozone from air.

23. The ozone neutralization system according to claim 1 wherein said chemical compound includes a liquid phase component, and wherein said purging means comprises:

a delivery line being operable to provide a substantially enclosed passageway for a delivery of said liquid phase component from said source to said neutralization means;

a first pump disposed in communication with said delivery line and said neutralization means, said first pump being operable to deliver said liquid phase component through said delivery line from said source to said neutralization means;

a preselected amount of a solvent, said solvent being operable to suspend said liquid phase component within said source, said solvent being operable to suspend said liquid phase component during delivery through said delivery line from said source to said neutralization means;

a solvent recirculation line being operable to provide a substantially enclosed passageway for a recirculation of said solvent from said neutralization means to said source; and a second pump disposed in communication with said neutralization means and said source, said second pump being operable to recirculate said solvent through said solvent recirculation line from said neutralization means to said source.

24. The ozone neutralization system according to claim 1 wherein said chemical compound includes a vapor phase component, and wherein said purging means comprises:

an enclosure being operable to substantially contain said source, said enclosure being operable to capture said vapor phase component; and a vacuum system operable to deliver said vapor phase component to said vapor phase neutralization means.

25. The ozone neutralization system according to claim 1 wherein said chemical compound includes a liquid phase component and a vapor phase component, and wherein said purging means comprises:

a delivery line being operable to provide a substantially enclosed passageway for a delivery of said liquid phase component from said source to said neutralization means;

a first pump disposed in communication with said delivery line and said neutralization means, said first pump being operable to deliver said liquid phase component through said delivery line from said source to said neutralization means;

a preselected amount of a solvent, said solvent being operable to suspend said liquid phase component within said source, said solvent being operable to suspend said liquid phase component during delivery through said delivery line from said source to said neutralization means;

a solvent recirculation line being operable to provide a substantially enclosed passageway for a recirculation of said solvent from said neutralization means to said source;

a second pump disposed in communication with said neutralization means and said source, said second pump being operable to recirculate said solvent through said solvent recirculation line from said neutralization means to said source.

an enclosure being operable to substantially contain said source, said enclosure being operable to capture said vapor phase component; and a vacuum system operable to deliver said vapor phase component to said vapor phase neutralization means.

26. The ozone neutralization system according to claim 1 wherein said chemical compound includes a liquid phase component, and wherein said neutralization means comprises:

a liquid phase reactor, said liquid phase reactor being operable to contain a solvent, said solvent being operable to suspend said liquid phase component within said liquid phase reactor;

an aerator disposed in communication with said liquid phase reactor, said aerator being operable to introduce ozone into said liquid phase reactor; and a venturi.

27. The ozone neutralization system according to claim 1 wherein said chemical compound includes a vapor phase component, and wherein said neutralization means comprises:

a vapor phase reactor, said vapor phase reactor being operable to contain a solvent, said solvent being operable to suspend said vapor phase component within said vapor phase reactor;

a solvent sprayer disposed in communication with said vapor phase reactor, said solvent sprayer being operable to contact said solvent with said vapor phase component;

an aerator disposed in communication with said vapor phase reactor, said aerator being operable to introduce ozone into said vapor phase reactor;

an ultraviolet light source being operable to provide ultraviolet light of wavelength from about 185 nm to about 254 nm; and a charcoal filter.

28. The ozone neutralization system according to claim 1 wherein said chemical compound includes a liquid phase component and a vapor phase component, and wherein said neutralization means comprises:

a liquid phase reactor, said liquid phase reactor being operable to contain a solvent, said solvent being operable to suspend said liquid phase component within said liquid phase reactor;

an aerator disposed in communication with said liquid phase reactor, said aerator being operable to introduce ozone into said liquid phase reactor;

a venturi;

a vapor phase reactor, said vapor phase reactor being operable to contain a solvent, said solvent being operable to suspend said vapor phase component within said vapor phase reactor;

a solvent sprayer disposed in communication with said vapor phase reactor, said solvent sprayer being operable to contact said solvent with said vapor phase component;

an aerator disposed in communication with said vapor phase reactor, said aerator being operable to introduce ozone into said vapor phase reactor;

an ultraviolet light source being operable to provide ultraviolet light of wavelength from about 185 nm to about 254 nm; and a charcoal filter.

29. The ozone neutralization system according to claim 1 wherein said source is a chemical munition.

30. The ozone neutralization system according to claim 1 further comprising at least one chemical catalyst disposed in communication with said neutralization means, each chemical catalyst being operable to facilitate breaking at least one chemical bond in said chemical compound.

31. The ozone neutralization system according to claim 30 wherein each catalyst is selected from the group consisting of metal oxides.

32. The ozone neutralization system according to claim 31 wherein each catalyst is selected from the group consisting of manganese oxide, nickel oxide, iron oxide, sponge nickel, platinum group metals and titanium dioxides.

33. The ozone neutralization system according to claim 1 wherein said chemical compound is selected from the group consisting of isopropyl methylphosphonofluoridate; bis(2-chloroethyl)sulphide 2,2'-dichloro diethyl sulphide; cyclohexyl methylphosphonofluoridate; ethyl-N, N-dimethylphosphoramidocyanidate; o-ethyl-S-(2-diisopropylaminoethyl)methylphosphonothioate; diphenylamine chloroarsine; methylphosphonofluoridic acid-1,2,2-trimethylpropylester; dichloro-2-chlorovinylarsine; and 2-2-di(3-chlorethyithio)-diethylether.

34. The ozone neutralization system according to claim 1 wherein said device is transportable.

* * * * *